US005479782A

United States Patent [19]

Parker et al.

[11] Patent Number: 5,479,782

[45] Date of Patent: Jan. 2, 1996

[54] GAS TURBINE COMBUSTOR

[75] Inventors: David M. Parker, Oviedo; David T. Foss; Perry E. Lowe, both of Winter Park; David J. Amos, Orlando, all of Fla.

[73] Assignee: Westinghouse Electric Corporation, Pittsburgh, Pa.

[21] Appl. No.: 319,686

[22] Filed: Oct. 7, 1994

Related U.S. Application Data

[62] Division of Ser. No. 141,757, Oct. 27, 1993, Pat. No. 5,394,688.

[51] Int. Cl.[6] ..... F02C 9/20

[52] U.S. Cl. ..... 60/747

[58] Field of Search ..... 60/742, 748, 760, 60/747, 737, 39.23, 746; 239/402.5, 406, 405, 404; 431/184

[56] References Cited

U.S. PATENT DOCUMENTS

| | | | |
|---|---|---|---|
| 2,958,194 | 11/1960 | Bayley | 60/760 |
| 3,788,067 | 1/1974 | Carlisle et al. | 60/742 |
| 3,844,116 | 10/1974 | Matto | 60/760 |
| 3,946,552 | 3/1976 | Weinstein et al. | 60/748 |
| 3,972,182 | 8/1976 | Salvi | 60/748 |
| 4,157,012 | 6/1979 | Dubell | 60/742 |
| 4,653,278 | 3/1987 | Vinson et al. | 60/748 |
| 4,805,397 | 2/1989 | Barbier et al. | 60/760 |
| 5,117,637 | 6/1992 | Howell et al. | 60/748 |
| 5,123,248 | 6/1992 | Monty et al. | 60/748 |
| 5,319,935 | 6/1994 | Toon et al. | 60/748 |

FOREIGN PATENT DOCUMENTS

| | | | |
|---|---|---|---|
| 2085147 | 4/1982 | United Kingdom | 60/748 |

*Primary Examiner*—Timothy S. Thorpe
*Attorney, Agent, or Firm*—M. G. Panian

[57] ABSTRACT

A combustor for a gas turbine having a centrally located fuel nozzle and inner, middle and outer concentric cylindrical liners, the inner liner enclosing a primary combustion zone. The combustor has an air inlet that forms two passages, each of which has a circumferential array of individually rotatable swirl vanes. The swirl vanes are mounted on axially oriented primary fuel pegs that extend through the air inlet passages. The middle and outer liners form an outer annular passage in which radially oriented secondary fuel pegs are disposed. The middle and inner liners form an inner annular passage that is supplied with cooling air. A perforated circumferentially extending baffle is locating in the inner annular passage and directs the cooling air to flow over the inner liner.

14 Claims, 5 Drawing Sheets

GAS TURBINE COMBUSTOR

This is a division of application Ser. No. 08/141,757 filed Oct. 27, 1993 now U.S. Pat. No. 5,394,688.

BACKGROUND OF THE INVENTION

The present invention relates to a combustor for burning fuel in compressed air. More specifically, the present invention relates to a low NOx combustor for a gas turbine.

In a gas turbine, fuel is burned in compressed air, produced by a compressor, in one or more combustors. Traditionally, such combustors had a primary combustion zone in which an approximately stoichiometric mixture of fuel and air was formed and burned in a diffusion type combustion process. Additional air was introduced into the combustor downstream of the primary combustion zone. Although the overall fuel/air ratio was considerably less than stoichiometric, the fuel/air mixture was readily ignited at start-up and good flame stability was achieved over a wide range in firing temperatures due to the locally richer nature of the fuel/air mixture in the primary combustion zone.

Unfortunately, use of such approximately stoichiometric fuel/air mixtures resulted in very high temperatures in the primary combustion zone. Such high temperatures promoted the formation of oxides of nitrogen ("NOx"), considered an atmospheric pollutant. It is known that combustion at lean fuel/air ratios reduces NOx formation. However, achieving such lean mixtures requires that the fuel be widely distributed and very well mixed into the combustion air. This can be accomplished by introducing the fuel into both primary and secondary annular air inlets using, in the case of gas fuel, fuel spray tubes distributed around the circumference of the annulus.

It has been found that mixing of the fuel and air is enhanced by using separate passages to divide the air in the primary air inlet into two streams. Radial swirlers, comprised of a number of swirl vanes distributed around the circumference of these passages, impart a swirl angle to the air that aids in the mixing of the fuel and air. The swirlers in each primary inlet passage are opposite handed so that the air exiting from the pre-mixing zone has little net swirl angle. Such a combustor is disclosed in "Industrial RB211 Dry Low Emission Combustion" by J. Willis et al., American Society of Mechanical Engineers (May 1993).

Unfortunately, such combustors suffer from a variety of drawbacks. First, the swirl vanes are integrally cast into a primary air inlet assembly, making it impossible to change the swirl angle once the combustor has been built. This makes it difficult to optimize the swirl conditions since it is not possible for the combustor designer to predict in advance the specific swirl angle that should be imparted to the air in order to achieve optimum results at a minimum pressure drop. Second, there is no capability of burning liquid fuel in such combustors since fuel spray tubes are relied upon exclusively to introduce fuel. Third, the fuel spray tubes that introduce fuel into the secondary air inlet passage are oriented axially and located upstream of the passage's inlet. This results in the failure of a portion of the fuel to enter the secondary air inlet passage, causing fouling and contamination of the combustor components exposed to the fuel. Fourth, the inner liner enclosing the primary combustion zone is subject to over-heating and deterioration, especially at its outlet edge.

It is therefore desirable to provide a gas turbine combustor having adjustable swirl vanes, dual fuel capability, accurate introduction of fuel into the secondary air inlet passage and adequate cooling of the liner that encloses the combustion zone.

SUMMARY OF THE INVENTION

Accordingly, it is the general object of the current invention to provide a gas turbine combustor having adjustable swirl vanes, dual fuel capability, accurate introduction of fuel into the secondary pre-mixing zone and adequate cooling of the liner that encloses the combustion zone.

Briefly, this object, as well as other objects of the current invention, is accomplished in a gas turbine having a compressor section for producing compressed air and a combustion section in which the compressed air is heated. The combustion section includes a combustor having (i) an air inlet in air flow communication with the compressor section, (ii) a plurality of first swirl vanes disposed in the air inlet for imparting a first swirl angle to at least a first portion of the compressed air, and (ii) first means for rotating each of the first swirl vanes into at least first and second positions, whereby the first swirl angle may be adjusted.

In one embodiment of the invention, the air inlet comprises first and second passages and the first swirl vanes are disposed in the first passage. Moreover, the combustor further comprises a plurality of second swirl vanes disposed in the second passage for imparting a second swirl angle to a second portion of the compressed air and second means for rotating each of the second swirl vanes into at least first and second positions, so that the second swirl angle may be adjusted. Preferably, each of the first vanes is rotatable about a common axis with one of the second vanes.

DESCRIPTION OF THE PREFERRED EMBODIMENT

Figure 1:
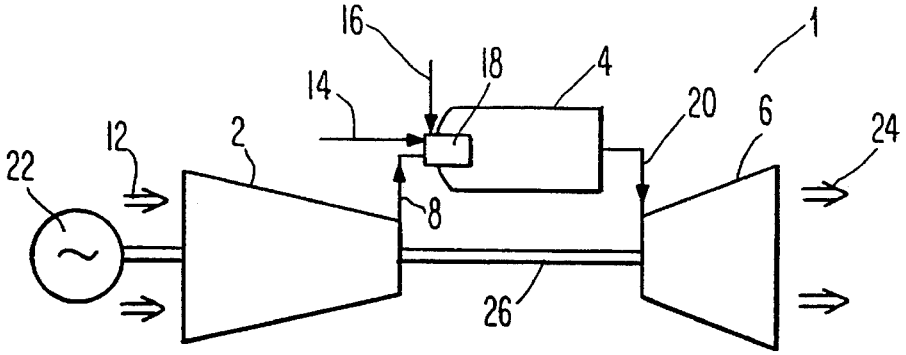
FIG. 1 is a schematic diagram of a gas turbine employing the combustor of the current invention.

Referring to the drawings, there is shown in FIG. 1 a schematic diagram of a gas turbine 1. The gas turbine 1 is comprised of a compressor 2 that is driven by a turbine 6 via a shaft 26. Ambient air 12 is drawn into the compressor 2 and compressed. The compressed air 8 produced by the compressor 2 is directed to a combustion system that includes one or more combustors 4 and a fuel nozzle 18 that introduces both gaseous fuel 16 and oil fuel 14 into the combustor. In the combustors 4, the fuel is burned in the compressed air 8, thereby producing a hot compressed gas 20.

The hot compressed gas 20 produced by the combustor 4 is directed to the turbine 6 where it is expanded, thereby producing shaft horsepower for driving the compressor 2, as well as a load, such as an electric generator 22. The expanded gas 24 produced by the turbine 6 is exhausted, either to the atmosphere directly or, in a combined cycle plant, to a heat recovery steam generator and then to atmosphere.

Figure 2:
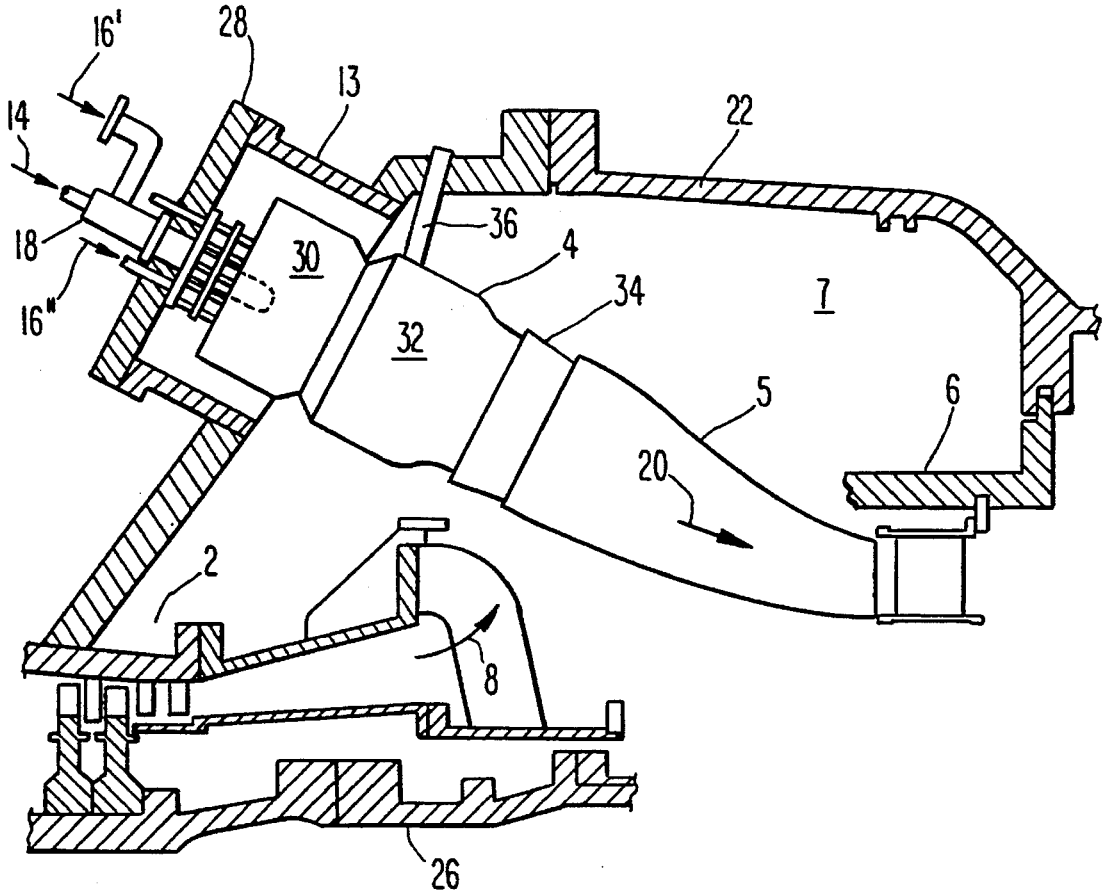
FIG. 2 is a longitudinal cross-section through the combustion section of the gas turbine shown in FIG. 1.

FIG. 2 shows the combustion section of the gas turbine 1. A circumferential array of combustors 4, only one of which is shown in FIG. 4, are connected by cross-flame tubes 82, shown in FIG. 3, and enclosed by a shell 22. Each combustor has a primary zone 30 and a secondary zone 32. The hot gas 20 exiting from the secondary zone 32 is directed by a duct 5 to the turbine section 6. The primary zone 30 of the combustor 4 is supported by a support plate 28. The support plate 28 is attached to a cylinder 13 that extends from the shell 22 and encloses the primary zone 30. The secondary zone 32 is supported by eight arms (not shown) extending from the support plate 13. Separately supporting the primary and second zones 30 and 32, respectively, reduces thermal stresses due to differential thermal expansion.

Figure 3:
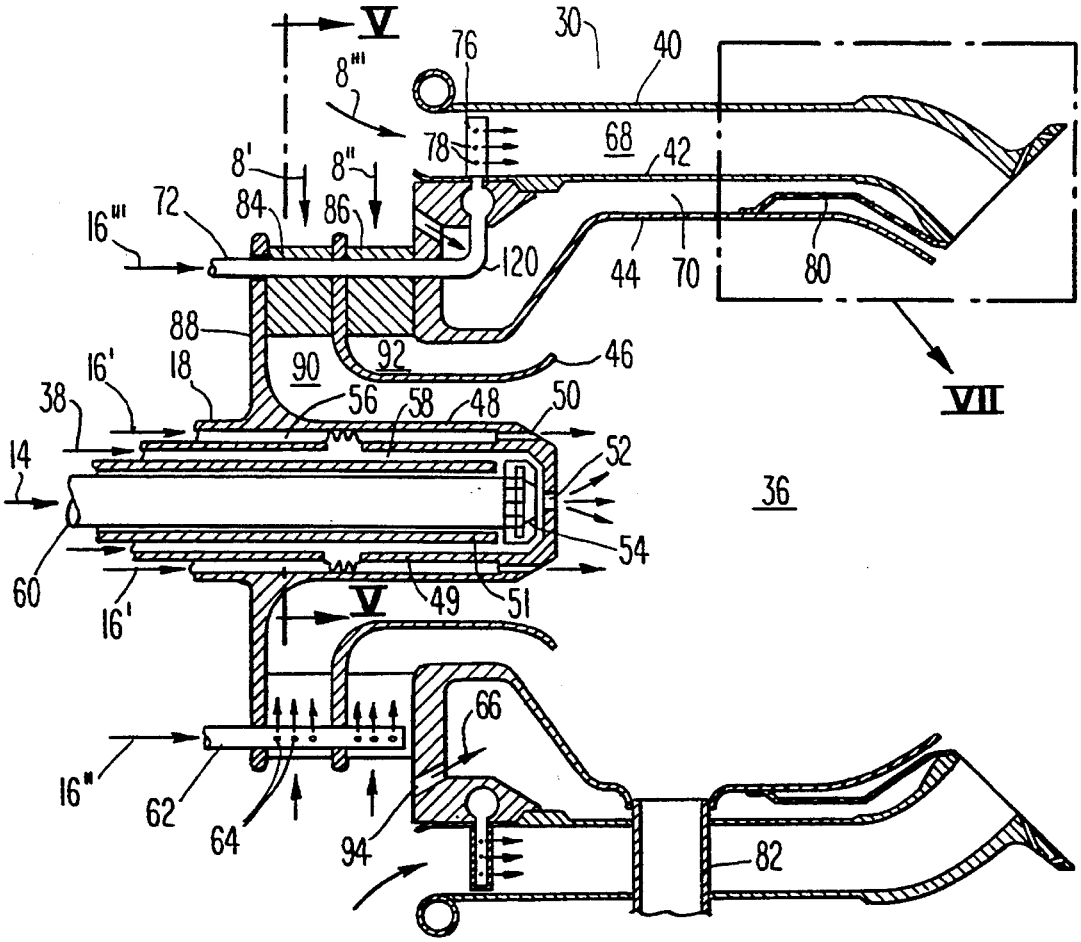
FIG. 3 is a longitudinal cross-section through the combustor shown in FIG. 2.
Figure 4:
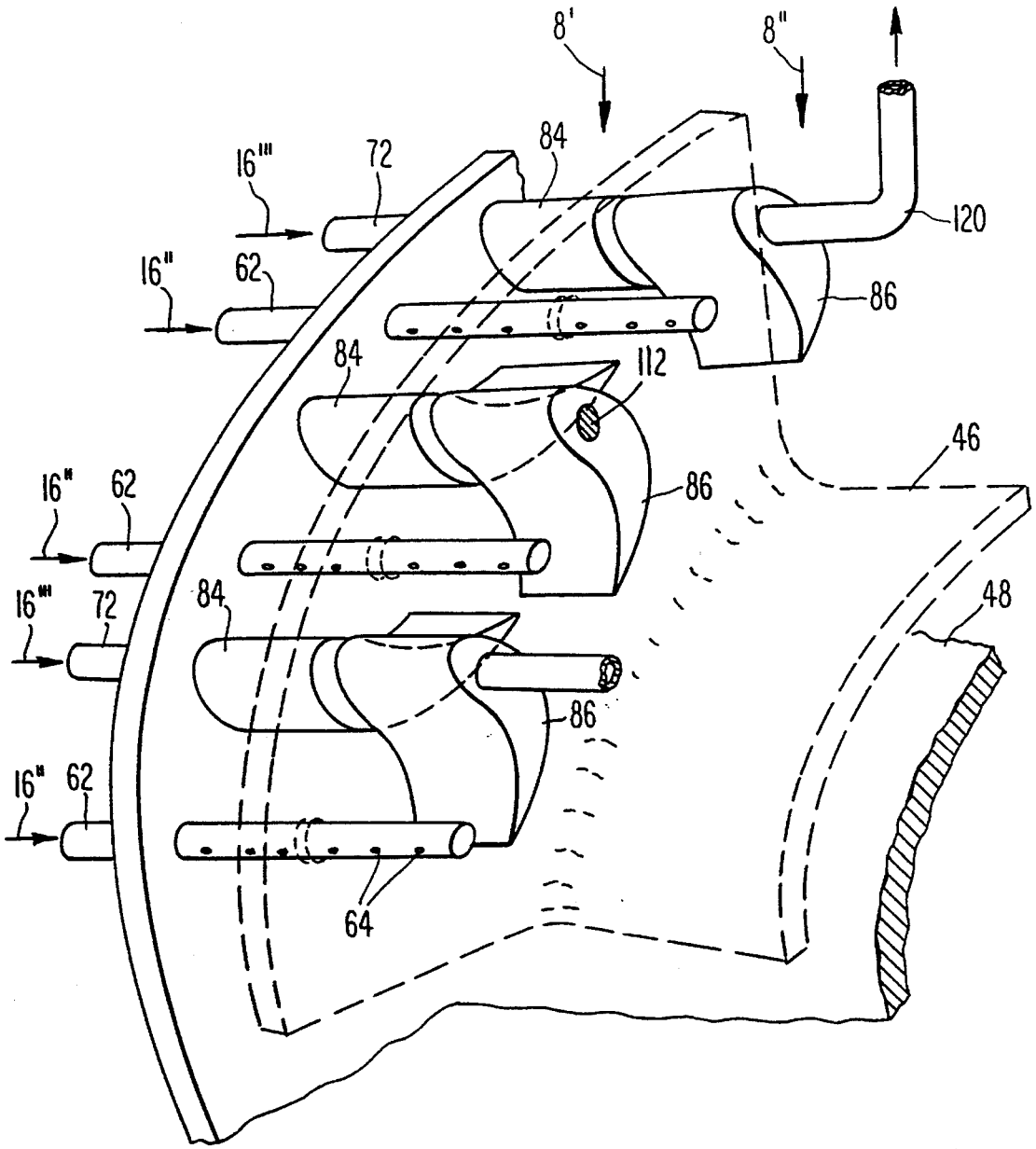
FIG. 4 is an isometric view of the air inlet portion of the combustor shown in FIG. 3, with the flow guide shown in phantom for clarity.

Referring to FIG. 3, a primary combustion zone 36, in which a lean mixture of fuel and air is burned, is located within the primary zone 30 of the combustor 4. Specifically, the primary combustion zone 36 is enclosed by a cylindrical inner liner 44 portion of the primary zone 30. The inner liner 44 is encircled by a cylindrical middle liner 42 that is, in turn, encircled by a cylindrical outer liner 40. The liners 40, 42 and 44 are concentrically arranged so that an inner annular passage 70 is formed between the inner and middle liners 44 and 42, respectively, and an outer annular passage 68 is formed between the middle and outer liners 42 and 44, respectively. Cross-flame tubes 82, one of which is shown in FIG. 3, extend through the liners 40, 42 and 44 and connect the primary combustion zones 36 of adjacent combustors 4 to facilitate ignition.

As shown in FIG. 3, according to the current invention, a dual fuel nozzle 18 is centrally disposed within the primary zone 30. The fuel nozzle 18 is comprised of a cylindrical outer sleeve 48, which forms an outer annular passage 56 with a cylindrical middle sleeve 49, and a cylindrical inner sleeve 51, which forms an inner annular passage 58 with the middle sleeve 49. An oil fuel supply tube 60 is disposed within the inner sleeve 51 and supplies oil fuel 14 to an oil fuel spray nozzle 54. The oil fuel 14 from the spray nozzle 54 enters the primary combustion zone 36 via an oil fuel discharge port 52 formed in the outer sleeve 48. Gas fuel 16' flows through the outer annular passage 56 and is discharged into the primary combustion zone 36 via a plurality of gas fuel ports 50 formed in the outer sleeve 48. In addition, cooling air 38 flows through the inner annular passage 58.

Compressed air from the compressor 2 is introduced into the primary combustion zone 36 by a primary air inlet formed in the front end of the primary zone 30. As shown in FIG. 3, the primary air inlet is formed by first and second passages 90 and 92 that divide the incoming air into two streams 8' and 8". The first inlet passage 90 has an upstream radial portion and a downstream axial portion. The upstream portion of the first passage 90 is formed between a radially extending circular flange 88 and the radially extending portion of a flow guide 46. The downstream portion is formed between the flow guide 46 and the outer sleeve 48 of the fuel nozzle 18 and is encircled by the second inlet passage 92.

The second inlet passage 92 also has an upstream radial portion and a downstream axial portion. The upstream portion of second passage 92 is formed between the radially extending portion of the flow guide 46 and a radially extending portion of the inner liner 44. The downstream portion of second passage 92 is formed between the axial portion of the flow guide 46 and an axially extending portion of the inner liner 44 and is encircled by the upstream portion of the passage 92. As shown in FIG. 3, the upstream portion of the second inlet passage 92 is disposed axially downstream from the upstream portion of first inlet passage 90 and the downstream portion of second inlet passage 92 encircles the downstream portion of the first inlet passage 90.

Figure 5:
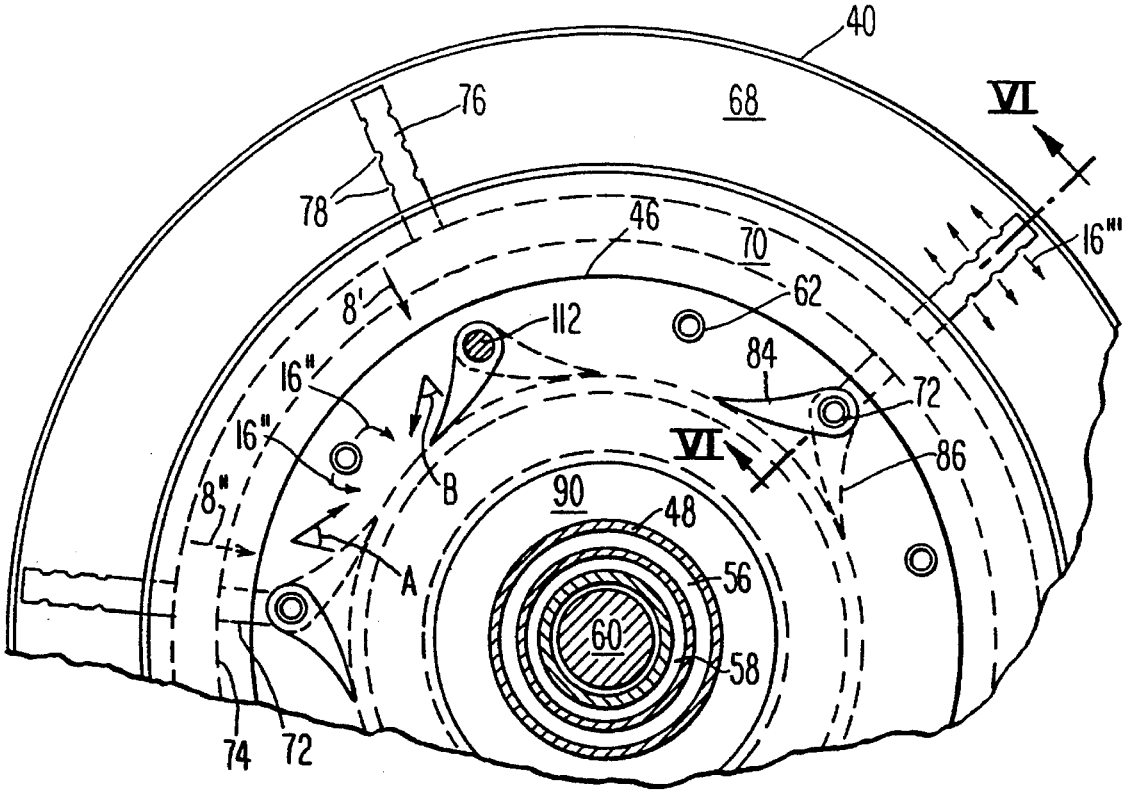
FIG. 5 is a transverse cross-section taken through lines V—V shown in FIG. 3.

As shown in FIGS. 3–5, a number of axially oriented, tubular primary fuel spray pegs 62 are distributed around the circumference of the primary air inlet so as to extend through the upstream portions of the both the first and second air inlet passages 90 and 92. Two rows of gas fuel discharge ports 64 are distributed along the length of each of the primary fuel pegs 62 so as to direct gas fuel 16" into the air steams 8' and 8" flowing through the inlet air passages 90 and 92. As shown best in FIG. 5, the gas fuel discharge ports 64 are oriented so as to discharge the gas fuel 16" circumferentially in the clockwise and counterclockwise directions.

As also shown in FIGS. 3–5, a number of swirl vanes 84 and 86 are distributed around the circumference of the upstream portions of the air inlet passages 90 and 92. In the preferred embodiment, a swirl vane is disposed between each of the primary fuel pegs 62. As shown in FIG. 5, the swirl vanes 84 in the inlet passage 90 impart a counterclockwise (when viewed in the direction of the axial flow) rotation to the air stream 8' so that the air forms a swirl angle B with the radial direction. The swirl vanes 86 in the inlet passage 92 impart a clockwise rotation to the air stream 8" so that the air forms a swirl angle A with the radial direction. The swirl imparted by the vanes 84 and 86 to the air streams 8' and 8" helps ensure good mixing between the gas fuel 16" and the air, thereby eliminating locally fuel rich mixtures and the associated high temperatures that increase NOx generation.

The outer annular passage 68 forms a secondary air inlet for the combustor through which air stream 8''' flows into the secondary zone 32. A number of secondary gas fuel spray pegs 76 are circumferentially distributed around the secondary air inlet passage 68. According to an important aspect of the current invention, the secondary fuel pegs 76 are disposed within the secondary air inlet passage 68 and are radially oriented to ensure that all of the gas fuel 16''' is properly directed into the secondary air inlet passage. The secondary fuel pegs 76 are supplied with fuel 16''' from a circumferentially extending manifold 74, shown best in FIG. 6.

Two rows of gas fuel discharge ports 78 are distributed along the length of each of the secondary fuel pegs 76 so as to direct gas fuel 16''' into the secondary air steams 8''' flowing through the secondary air inlet passage 68. As shown best in FIG. 5, the gas fuel discharge ports 78 are oriented so as to discharge the gas fuel 16''' circumferentially in both the clockwise and counterclockwise directions. Because of the 180° turn made by the secondary air 8''' as it enters passage 68, the radial velocity distribution of the air will be non-linear. Hence, the spacing between the fuel discharge ports 78 may be adjusted to match the velocity distribution, thereby providing optimum mixing of the fuel and air.

In operation, a flame is initially established in the primary combustion zone 36 by the introduction of fuel, either oil 14 or gas 16' via the central fuel nozzle 18. As increasing load on the turbine 6 requires higher firing temperatures, additional fuel is added by introducing gas fuel 16" via the primary fuel pegs 62. Since the primary fuel pegs 62 result in a much better distribution of the fuel within the air, they produce a leaner fuel/air mixture than the central nozzle 18 and hence lower NOx. Thus, once ignition is established in the primary combustion zone 36, the fuel to the central nozzle 18 can be shut-off. Further demand for fuel flow beyond that supplied by the primary fuel pegs 62 can then be satisfied by supplying additional fuel 16''' via the secondary fuel pegs 76.

As shown in FIG. 3, preferably, the swirl vanes 84 and 86 are oriented in opposition to each other so that the swirl angles A and B tend to cancel each other out, resulting in zero net swirl in the primary combustion zone 36. The optimum angle for the swirl vanes 84 and 86 that will result in good mixing with a minimum of pressure drop will depend on the specific combustor design and is difficult to predict in advance. Therefore, according to an important aspect of the current invention, the swirl vanes 84 and 86 can be rotated into various angles.

Figure 8:
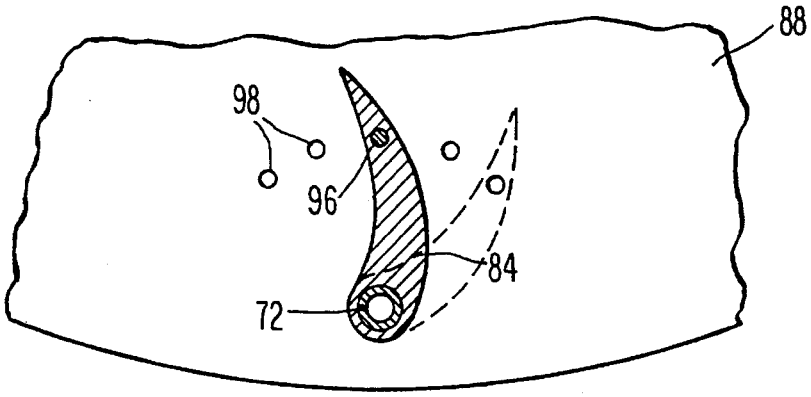
FIG. 8 is a cross-section taken through lines VIII—VIII shown in FIG. 6.
Figure 6:
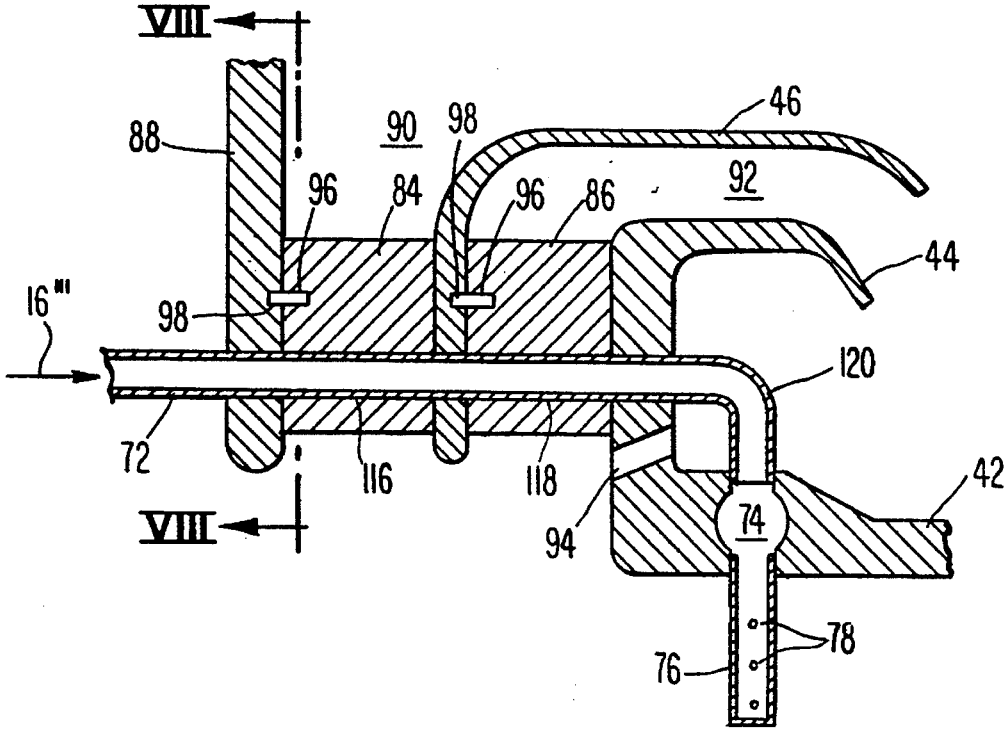
FIG. 6 is a cross-section taken through line VI—VI shown in FIG. 5 and shows a portion of the combustor air inlet in the vicinity of the swirl vanes, except that in FIG. 6 the swirl vanes have been rotated from their position shown in FIG. 5 so as to be essentially oriented at 0° to the radial direction to allow viewing of the retainer pins in both vanes in a single cross-section.

As shown in FIGS. 6 and 8, the rotatability of the swirl vanes 84 and 86 is achieved by rotatably mounting the swirl vanes 84 and 86 in pairs along a common axis. In the preferred embodiment, this is accomplished by mounting alternate swirl vane pairs on shafts formed by the tubes 72 that supply fuel 16''' to the secondary fuel pegs 76—specifically, the fuel peg supply tubes 72 extend through close fitting holes 116 and 118 in the swirl vanes 84 and 86. The remaining swirl vane pairs are rotatably mounted on close fitting alignment bolts, such as the bolts 112 shown in FIG. 9, instead of on the secondary fuel peg supply tubes 72. In addition to allowing rotation of the swirl vanes, the alignment bolts 112 serve to clamp the assembly together and provide concentric alignment of flow guide 46 and the inner liner 44.

As shown in FIG. 6, a pin 96 is installed in each swirl vane and extends into a hole 98 that is formed in either the flange 88, in the case of the swirl vanes 84, or in the radial portion of the flow guide 46, in the case of the swirl vanes 86. The pins 96 lock the swirl vanes into a predetermined angular orientation.

As shown in FIG. 8, a number of lock pin holes 98 are formed in the flange 88 for each swirl vane 84. These holes are arranged in an arc so that the angle of each swirl vane 84 can be individually adjusted by varying the hole into which the pin 96 is placed when the combustor is assembled. A similar array of holes 98 are formed in the flow guide 46 to allow individual adjustment of the angle of the swirl vanes 86. Thus, according to the current invention, the angle of the swirl vanes 84 and 86 can be individually adjusted to obtain the optimum swirl angles A and B for the incoming air.

Figure 9:
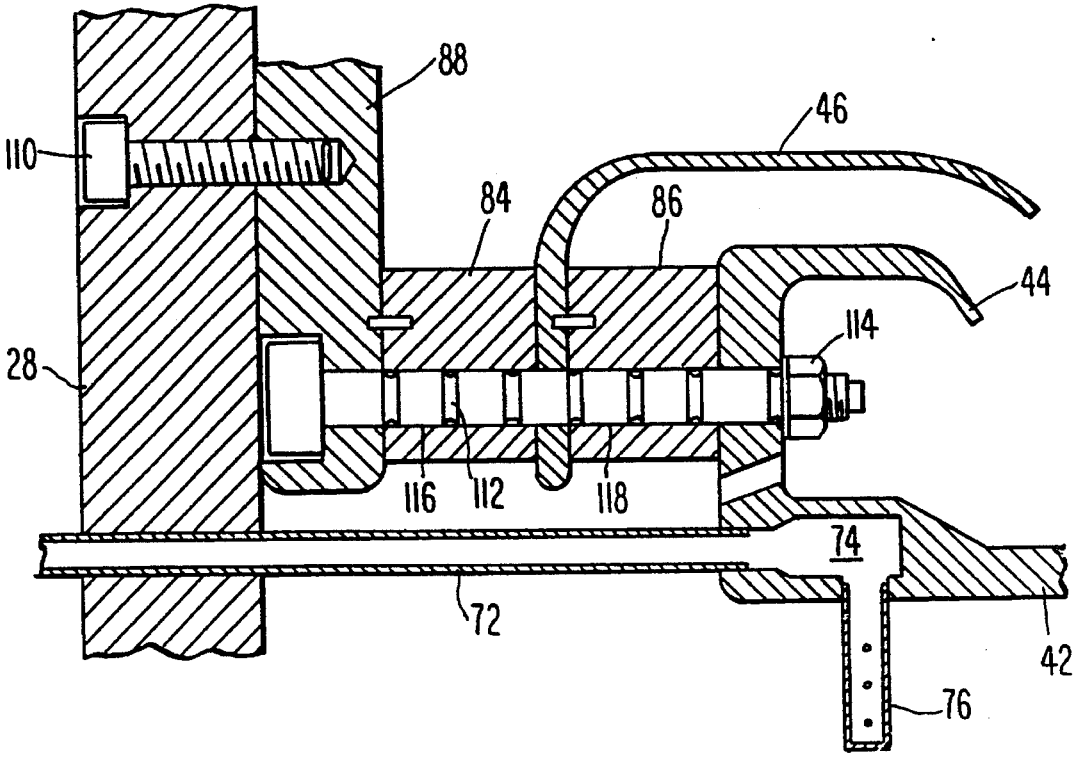
FIG. 9 is an alternate embodiment of the swirl vane support shown in FIG. 6.

FIG. 9 shows an alternative embodiment of the current invention whereby all of the pairs of swirl vanes 84 and 86 are rotatably mounted on close fitting alignment bolts 112, instead of mounting alternating vane pairs on the secondary fuel peg supply tubes 72. The head of each bolt 112 is secured to the flange 88 and a nut 114 is threaded onto the bolt to secure the assembly in place. In this embodiment, the fuel tubes 72 extend directly across the inlet of the passages 90 and 92 to the manifold 74.

Since the inner liner 44 is directly exposed to the hot combustion gas in the primary combustion zone 36, it is important to cool the liner, especially at its downstream end adjacent the outlet 71. According to the current invention, this is accomplished by forming a number of holes 94 in the radially extending portion of the inner liner 44, as shown in FIG. 3. These holes 94 allow a portion 66 of the compressed air 8 from the compressor section 2 to enter the annular passage 70 formed between the inner liner 44 and the middle liner 42.

Figure 7:
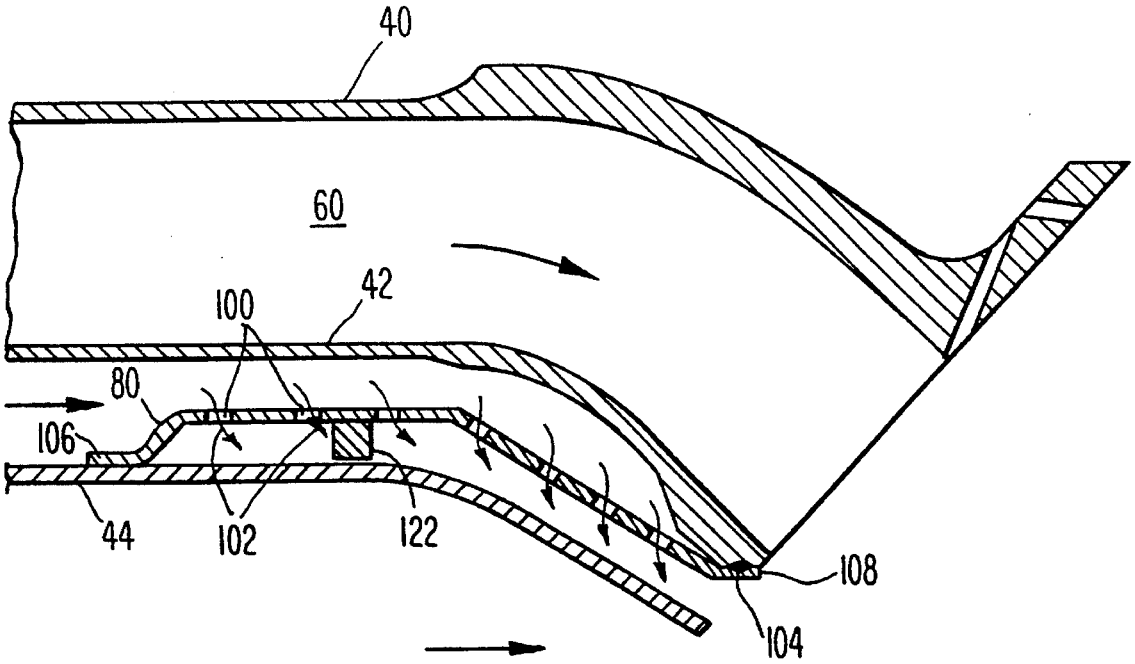
FIG. 7 is a detailed view of the portion of FIG. 3 enclosed by the oval marked VII.

As shown in FIG. 7, according at an important aspect of the current invention, an approximately cylindrical baffle 80 is located at the outlet of the passage 70 and extends between the inner liner 44 and the middle liner 42. In the preferred embodiment, the baffle 80 is attached at its downstream end 108 to the downstream end of the middle liner 42 via spot welds 104. Alternatively, the downstream end 108 of the baffle 80 could be attached to the middle liner 42 via a fillet weld. The front end 106 of the baffle 80 is sprung loaded to bear against the outer surface of the inner liner 44. As shown in FIGS. 3 and 7 the front end 106 of the baffle 80 extends upstream only about one-third the length of the inner liner 44. However, in some cases, it may be preferable to extend the front end 106 of the baffle 80 further upstream so that the baffle encircles the entire large diameter portion of the inner liner 44.

As shown in FIG. 7, a number of holes 100 are distributed around the circumference of the baffle 80 and divide the cooling air 66 into a number of jets 102 that impinge on the outer surface of the inner liner 44. Thus, the baffle 80 allows the cooling air 66 to be used much more effectively in terms of cooling the inner liner 44.

To prevent the inner liner 44 from vibrating at it downstream end, in one embodiment of the current invention, inwardly projecting snubber blocks 122 are distributed around the circumference of the baffle 80 to provide frictional damping for the inner liner 44, as shown in FIG. 7. The snubbers 122 are preferably coated with a wear resistant coating. Preferably, the snubbers 122 are sized so that there is a clearance between them and the inner liner 44 at assembly. However, during operation the differential thermal expansion between the inner liner 44 and the baffle 80 will cause the inner liner to grow more than the baffle and contact the snubbers 122, thereby creating the desired damping. Thus, the baffle 80 not only cools the inner liner 44 but reduces its vibration.

The present invention may be embodied in other specific forms without departing from the spirit or essential attributes thereof and, accordingly, reference should be made to the appended claims, rather than to the foregoing specification, as indicating the scope of the invention.

We claim:

1. In a gas turbine having a compressor for producing compressed air, a combustor for heating said compressed air comprising:

a) a first substantially cylindrical liner forming a chamber therein for containing a combustion zone, a second substantially cylindrical liner forming an outer annular passage encircling said first liner;

b) a flow guide forming a first inlet passage having first and second portions, said first portion extending axially and being concentric with said liner, said second portion extending radially and encircling said first portion;

c) a plurality of fuel discharge means extending radially into said outer annular passage, each of said fuel discharge means having a plurality of fuel discharge ports formed therein;

d) a second inlet passage for said chamber, said second inlet passage having first and second portions, said first portion of said second inlet passage formed between said fuel nozzle and said flow guide and extending axially and being concentric with said first portion of said first inlet passage, said second portion of said second inlet passage extending radially and encircling said first portion of said second inlet passage;

e) a plurality of first swirl vanes disposed in said second portion of said first inlet passage; and f) a plurality of second swirl vanes disposed in said second portion of said second inlet passage.

2. The combustor according to claim 1, further comprising means for rotating said first and second swirl vanes.

3. The combustor according to claim 1, further comprising a third substantially cylindrical liner enclosed by said second liner, said outer annular passage formed between said second and third liners, said first and second liners forming an inner annular passage therebetween.

4. The combustor according to claim 3, further comprising means for introducing cooling air into said inner annular passage.

5. The combustor according to claim 4, further comprising a circumferentially extending baffle disposed in said inner annular passage.

6. The combustor according to claim 5, wherein said baffle has means for directing cooling air introduced into said inner annular passage to flow over said first liner.

7. The combustor according to claim 6, wherein said baffle has means for reducing vibration of said inner liner.

8. The combustor according to claim 7, further comprising means for rotating said first and second swirl vanes.

9. In a gas turbine having a compressor for producing compressed air, a combustor for heating said compressed air comprising:

a) a first liner forming a chamber therein for containing a combustion zone, a second liner encircling said first liner and a third liner enclosed by said second liner, an outer annular passage being formed between said second and third liners, and an inner annular passage being formed between said first and second liners;

b) a flow guide forming a first inlet passage having first and second portions, said first portion extending axially and being concentric with said liner, said second portion extending radially and encircling said first portion;

c) a centrally disposed fuel nozzle in fuel flow communication with said chamber;

d) a second inlet passage for said chamber, said second inlet passage having first and second portions, said first portion of said second inlet passage formed between said fuel nozzle and said flow guide and extending axially and being concentric with said first portion of said first inlet passage, said second portion of said second inlet passage extending radially and encircling said first portion of said second inlet passage;

e) a plurality of first swirl vanes disposed in said second portion of said first inlet passage; and f) a plurality of second swirl vanes disposed in said second portion of said second inlet passage.

10. The combustor according to claim 9, further comprising means for rotating said first and second swirl vanes.

11. The combustor according to claim 9, further comprising means for introducing cooling air into said inner annular passage.

12. The combustor according to claim 11, further comprising a circumferentially extending baffle disposed in said inner annular passage.

13. The combustor according to claim 12, wherein said baffle has means for directing cooling air introduced into said inner annular passage to flow over said first liner.

14. The combustor according to claim 12, wherein said baffle has means for reducing vibration of said inner liner.

* * * * *